US011879639B2

(12) United States Patent
Dueck

(10) Patent No.: US 11,879,639 B2
(45) Date of Patent: Jan. 23, 2024

(54) FUEL MANAGEMENT SYSTEM FOR A BIOMASS FURNACE

(71) Applicant: Raymond Dueck, East St. Paul (CA)

(72) Inventor: Raymond Dueck, East St. Paul (CA)

( * ) Notice: Subject to any disclaimer, the term of this patent is extended or adjusted under 35 U.S.C. 154(b) by 523 days.

(21) Appl. No.: 17/125,285

(22) Filed: Dec. 17, 2020

(65) Prior Publication Data

US 2021/0190314 A1 Jun. 24, 2021

Related U.S. Application Data

(60) Provisional application No. 62/950,210, filed on Dec. 19, 2019.

(51) Int. Cl.
*F23K 3/14* (2006.01)
*F23J 1/02* (2006.01)
*F23B 40/08* (2006.01)

(52) U.S. Cl.
CPC ..... *F23K 3/14* (2013.01); *F23B 40/08* (2013.01); *F23J 1/02* (2013.01)

(58) Field of Classification Search
None
See application file for complete search history.

(56) References Cited

U.S. PATENT DOCUMENTS 638,089 A * 11/1899 Brown et al. ..... F23M 5/02 110/165 R
1,388,714 A * 8/1921 Hofmann ..... F23H 11/00 110/273
2,534,634 A * 12/1950 Sparks ..... F23J 1/00 110/165 R
3,504,645 A * 4/1970 Davenport ..... F23J 1/02 110/165 R
4,593,629 A * 6/1986 Pedersen ..... F23K 3/14 110/172
5,269,233 A * 12/1993 Johnson ..... F23K 3/00 414/175
9,016,215 B2 * 4/2015 Ozyaman ..... F23B 80/04 110/165 R
11,662,092 B2 * 5/2023 O'Connor ..... F23G 5/002 110/101 R
2001/0027737 A1 * 10/2001 Abrams ..... F23G 5/0276 110/191
2014/0083339 A1 * 3/2014 Moreno Rueda ..... F23G 5/002 110/165 R
2021/0363918 A1 * 11/2021 Gaudreault ..... F23G 5/006

* cited by examiner

*Primary Examiner* — David J Laux
(74) *Attorney, Agent, or Firm* — Christopher J. Dynowski; Ryan W. Dupuis; Ade & Company Inc.

(57) ABSTRACT

A fuel management system for a biomass furnace features a common drive motor operatively coupled to both a fuel delivery conveyor, which is arranged to support and displace fuel during combustion in a combustion chamber of the furnace, and an ash removal conveyor which is arranged to transfer ash generated by the combustion out of the combustion chamber. The system also features ducting which extends around the fuel delivery conveyor to convey airflow generated by a blower for subsequent discharge both below and above the fuel during combustion. Furthermore, the system features a housing which operably supports at least the fuel delivery conveyor and which is arranged to be removably insertible into the combustion chamber of the furnace.

18 Claims, 5 Drawing Sheets

83
86
113
45
90
6
2
4
99
36
34A
63
49
77
75
112
31
43
46
40
37
22
69
30
33
24
17
27
52
59
52A
14
12
17
19
18

FUEL MANAGEMENT SYSTEM FOR A BIOMASS FURNACE

This application claims the benefit under 35 U.S.C. 119(e) of U.S. Provisional Application Ser. No. 62/950,210 filed Dec. 19, 2019, which is incorporated by reference herein.

FIELD OF THE INVENTION

The present invention relates generally to a biomass furnace for transferring heat from combustion of biomass fuel in a combustion chamber of the furnace to a heating medium such as a fluid, whether liquid or gaseous, and more particularly to a fuel management system of the biomass furnace having a fuel delivery conveyor for supporting and displacing the fuel during combustion within the combustion chamber. The fuel management system is designed to be particularly suited for handling biomass fuel in the form of wood chips which generate ash following combustion.

BACKGROUND

It is known to provide a biomass furnace for transferring heat from combustion of biomass fuel in a combustion chamber of the furnace to a heating medium with a conveyor located in the combustion chamber to move or displace the fuel within the combustion chamber as it is being combusted. This allows the fuel already under combustion to be moved away from an inlet through which fuel is added to the combustion chamber for subsequent combustion so that the combustion chamber can be continuously replenished with fuel in a manner which substantially does not affect existing combustion. Biomass fuel which is consumed in such a furnace is generally provided in particulate form, and particularly in pelletized form, for example wood pellets. Pelletized biomass fuel typically burns clean so as not to leave behind substantial waste that requires cleaning to ensure reliable continued operation of the biomass furnace

SUMMARY OF THE INVENTION

According to an aspect of the invention there is provided a fuel management system for a biomass furnace having a combustion chamber, comprising:

a fuel delivery conveyor arranged to be located in the combustion chamber for receiving biomass fuel to be combusted therein, the fuel delivery conveyor defining a support surface for supporting the fuel during combustion and being operable to displace the fuel as the fuel is being combusted in the combustion chamber; and an ash removal conveyor operatively communicated with the fuel delivery conveyor to receive therefrom ash generated by the combustion of the fuel, the ash removal conveyor being arranged to transfer the ash to a location external of the combustion chamber.

Thus there is provided a conveyor for automatically removing the ash generated by combustion so that the fuel management system can continue to generate heat without interference due to the generated ash.

According to another aspect of the invention there is provided a fuel management system for a biomass furnace having a combustion chamber, comprising:

a fuel delivery conveyor arranged to be located in the combustion chamber for receiving biomass fuel to be combusted therein, the fuel delivery conveyor defining a support surface for supporting the fuel during combustion and being operable to displace the fuel in a conveyance direction of the fuel delivery conveyor as the fuel is being combusted in the combustion chamber;

an ash removal conveyor operatively communicated with the fuel delivery conveyor to receive therefrom ash generated by the combustion of the fuel, the ash removal conveyor being arranged to transfer the ash to a location external of the combustion chamber and being operable to displace the ash in a discharge direction which is substantially parallel to the conveyance direction of the fuel delivery conveyor; and a common drive motor operatively coupled to both the fuel delivery conveyor and the ash removal conveyor to actuate the fuel delivery conveyor to displace the fuel and the ash removal conveyor to displace the ash.

This arrangement enables a single motor to drive two distinct conveyors of the system.

According to yet another aspect of the invention there is provided a fuel management system for a biomass furnace having a combustion chamber, comprising:

a fuel delivery conveyor arranged to be located in the combustion chamber for receiving biomass fuel to be combusted therein;

the fuel delivery conveyor being operable to displace the fuel in a conveyance direction of the fuel delivery conveyor as the fuel is being combusted in the combustion chamber;

the fuel delivery conveyor defining a support surface for supporting the fuel during combustion, the support surface locating a plurality of openings sized to prevent passage of the fuel which is not combusted;

ducting arranged to convey airflow generated by a blower for subsequent discharge into the combustion chamber;

the ducting defining at least one orifice below the support surface of the fuel delivery conveyor to supply the airflow at a location beneath the fuel; and the ducting including one or more air nozzles at spaced locations along the conveyance direction and extending in a generally upward direction above the support surface for supplying the airflow at a location above the fuel.

In this arrangement common ducting feeds both underfire and overfire airflow.

According to a further aspect of the invention there is provided a fuel management system for a biomass furnace having a combustion chamber, comprising:

a fuel delivery conveyor arranged to be located in the combustion chamber for receiving biomass fuel to be combusted therein;

the fuel delivery conveyor being operable to displace the fuel in a conveyance direction of the fuel delivery conveyor as the fuel is being combusted in the combustion chamber;

the fuel delivery conveyor defining a support surface for supporting the fuel during combustion;

a housing operably supporting the fuel delivery conveyor;

the housing being arranged to be removably insertible into the combustion chamber of the furnace.

This provides an arrangement of fuel management system which is removable from the combustion chamber for easy maintenance of mechanical components.

According to yet a further aspect of the invention there is provided a biomass furnace for transferring heat from combustion of biomass fuel to a heating fluid, comprising:

a combustion chamber arranging for containing the combustion of the fuel;

a heat exchanger assembly in fluidic communication with the combustion chamber for receiving gases generated by the combustion of the fuel and arranged to transfer heat from the gases to the heating fluid;

a flue in fluidic communication with the heat exchanger assembly arranged for guiding the gases which have passed through the heat exchanger assembly away therefrom;

a fuel delivery conveyor located in the combustion chamber for receiving the fuel to be combusted therein;

the fuel delivery conveyor being operable to displace the fuel in a conveyance direction of the fuel delivery conveyor as the fuel is being combusted in the combustion chamber;

the fuel delivery conveyor defining a support surface for supporting the fuel during combustion; and a housing operably supporting the fuel delivery conveyor and being removably insertible into the combustion chamber through an opening defined by the combustion chamber.

In one arrangement the fuel management system further includes a guide member supported over the support surface of the fuel delivery conveyor at a spaced location from an inlet through which the fuel is passed to the fuel delivery conveyor to substantially obstruct passage of ash in the conveyance direction, the guide member defining an upstanding surface to said support surface which is oriented at an acute angle to the conveyance direction of the fuel delivery conveyor so as to guide the ash to one side of the fuel delivery conveyor for subsequent transfer to the ash removal conveyor.

In one arrangement, when the support surface of the fuel delivery conveyor locates a plurality of openings sized to prevent passage of the fuel which is not combusted but to enable passage of the ash therethrough, the system includes a chute extending underneath the support surface and arranged to guide the ash which has passed through the openings to the ash removal conveyor by gravity.

In one arrangement the chute defines an upper guide surface extending in the conveyance direction and sloped downwardly to one side of the fuel delivery conveyor to guide the ash towards the ash removal conveyor.

In one arrangement, when the system further includes a guide member supported over the support surface of the fuel delivery conveyor at a spaced location from an inlet through which the fuel is passed to the fuel delivery conveyor and defining an upstanding surface to the support surface to substantially obstruct passage of ash in the conveyance direction, an end of the chute is spaced in the conveyance direction from the upstanding surface so as to capture ash passing under the guide member.

In one arrangement the system further includes an ash transfer conveyor arranged externally of the combustion chamber and operatively communicated with the ash removal conveyor to receive the ash therefrom, the ash transfer conveyor being transversely oriented to the ash removal conveyor and being operable to displace the ash in a transverse direction to the discharge direction.

In one arrangement the ash transfer conveyor is also operatively coupled to the common drive motor so as to be actuated thereby to displace the ash in the transverse direction.

In one arrangement, drive shafts of the fuel delivery conveyor and the ash transfer conveyor are substantially parallel, a drive shaft of the ash removal conveyor is transversely oriented to the drive shaft of the fuel delivery conveyor, and wherein there is provided a first transmission operatively interconnecting the common drive motor and the drive shaft of the ash removal conveyor, and a second transmission operatively interconnecting the common drive motor and the drive shaft of each of the fuel delivery conveyor and the ash transfer conveyor.

In one arrangement the second transmission is operatively connected to the drive motor via the first transmission.

In one arrangement, when the system includes ducting arranged to convey airflow generated by a blower for subsequent discharge into the combustion chamber, and when the support surface of the fuel delivery conveyor locates a plurality of openings sized to prevent passage of the fuel which is not combusted, the ducting defines at least one orifice below the support surface of the fuel delivery conveyor to supply the airflow at a location beneath the fuel and also includes one or more air nozzles at spaced locations along the conveyance direction and extending in a generally upward direction above the support surface for supplying the airflow at a location above the fuel.

In one arrangement, when the support surface of the fuel delivery conveyor locates a plurality of openings sized to prevent passage of the fuel which is not combusted but to enable passage of the ash therethrough, and there is provided a chute extending underneath the support surface and arranged to guide the ash which has passed through the openings by gravity to waste, the at least one orifice is disposed above the chute and is configured to provide the airflow across a width of the chute to assist discharge of the ash to the ash removal conveyor or, generally, to waste.

In one arrangement the ducting extends generally in a U shape from one side of the fuel delivery conveyor, around an end of the support surface of the fuel delivery conveyor arranged at a spaced location from an inlet through which the fuel is passed to the fuel delivery conveyor, and to the other side of the fuel delivery conveyor, and the one or more air nozzles comprises a plurality of air nozzles located on either side of the fuel delivery conveyor.

In one arrangement the system further includes a single blower mounted in fluidic communication with the ducting and arranged to provide the airflow.

In one arrangement the single blower is mounted to one side of the fuel delivery conveyor.

In one arrangement the fuel delivery and ash removal conveyors and the drive motor are operably mounted on a common housing which is arranged to be removably insertible into the combustion chamber of the furnace.

In one arrangement, when the fuel management system further includes ducting arranged to convey airflow generated by a blower for subsequent discharge into the combustion chamber and which extends generally in a U shape from one side of the fuel delivery conveyor, around an end of the support surface of the fuel delivery conveyor arranged at a spaced location from an inlet through which the fuel is passed to the fuel delivery conveyor, and to the other side of the fuel delivery conveyor, the housing defines the ducting.

In one arrangement the housing comprises an exterior wall arranged to be located on an exterior side of the combustion chamber in which a ducting inlet is defined so as to communicate the ducting and the blower located externally of the housing.

In one arrangement, when the fuel management system further includes further including an ash transfer conveyor arranged externally of the combustion chamber and operatively communicated with the ash removal conveyor to receive the ash therefrom, the ash transfer conveyor is operably mounted on the common housing so as to be movable relative to the combustion chamber with the housing.

In one arrangement the drive motor is arranged to be located externally of the combustion chamber.

In one arrangement, when the fuel management system further includes at least one transmission operatively interconnecting the drive motor and drive shafts of the fuel delivery and ash removal conveyors, said at least one transmission is arranged to be mounted externally of the combustion chamber.

In one arrangement the ash removal conveyor is located to one side of the fuel delivery conveyor.

In one arrangement the ash removal conveyor is located at a height below the support surface of the fuel delivery conveyor.

In one arrangement the ash removal conveyor is operable to displace the ash in the discharge direction which is opposite to the conveyance direction of the fuel delivery conveyor.

In one arrangement, when the system further includes an ash removal conveyor operatively communicated with the fuel delivery conveyor to receive therefrom ash generated by the combustion of the fuel, the ash removal conveyor is operably mounted on the housing so as to be movable relative to the combustion chamber with the housing.

In one arrangement, when the system further includes an ash transfer conveyor operatively communicated with the ash removal conveyor to receive the ash therefrom and being operable to displace the ash in a transverse direction to the discharge direction, the ash transfer conveyor is operably mounted on the housing so as to be movable relative to the combustion chamber with the housing.

In one arrangement, when the system further includes ducting arranged to convey airflow generated by a blower for subsequent discharge into the combustion chamber, the ducting is defined by the housing.

In one arrangement, when the combustion chamber of the biomass furnace defines an opening arranged to permit passage of the housing into and out of the combustion chamber, the housing comprises an exterior wall arranged to be located on an exterior side of the combustion chamber and to close said opening of the combustion chamber and an inlet is defined in the exterior wall and arranged to permit passage of the fuel from a fuel supply located externally of the combustion chamber to the fuel delivery conveyor.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
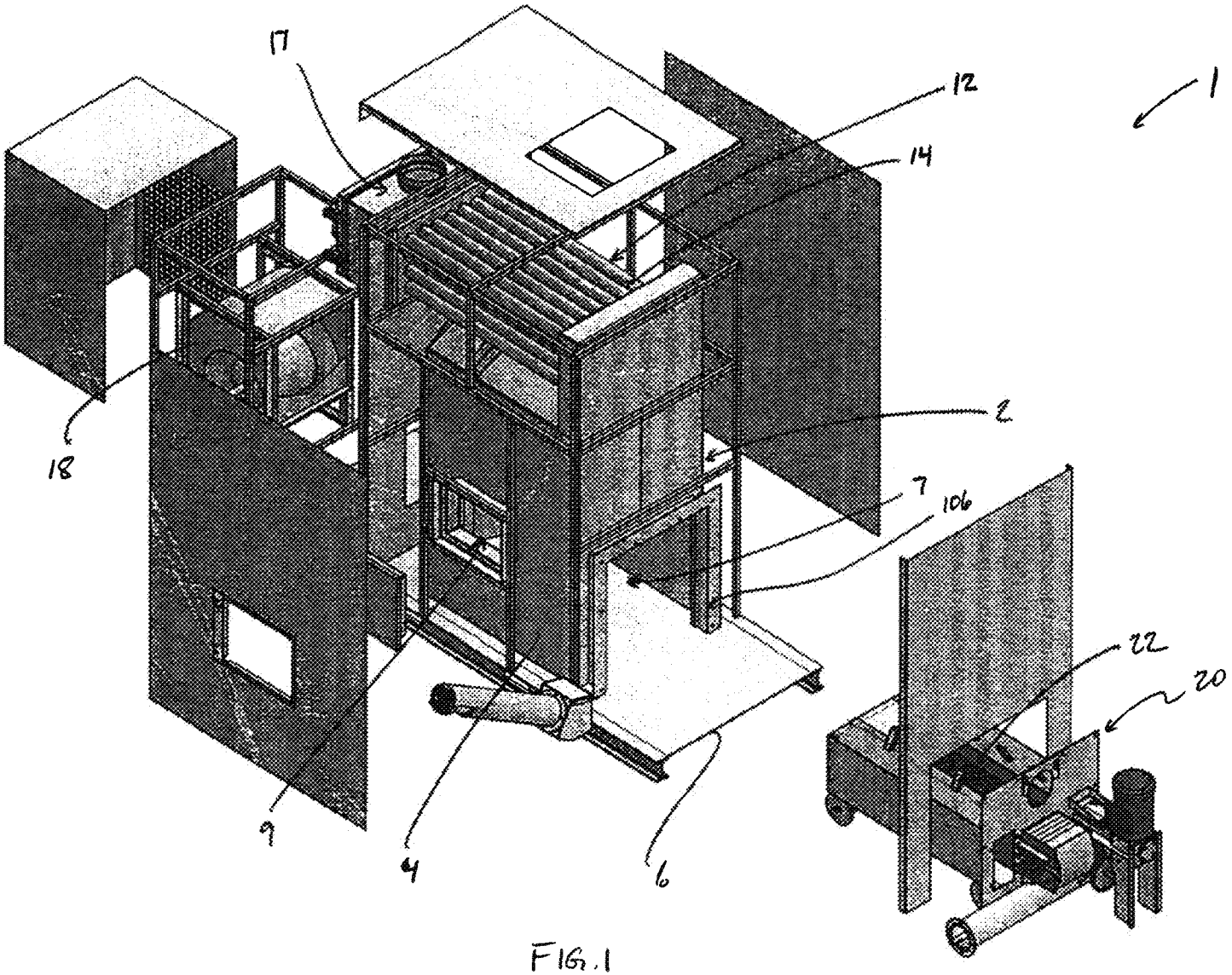
FIG. 1 is an exploded view of an arrangement of biomass furnace according to the present invention.
Figure 4:
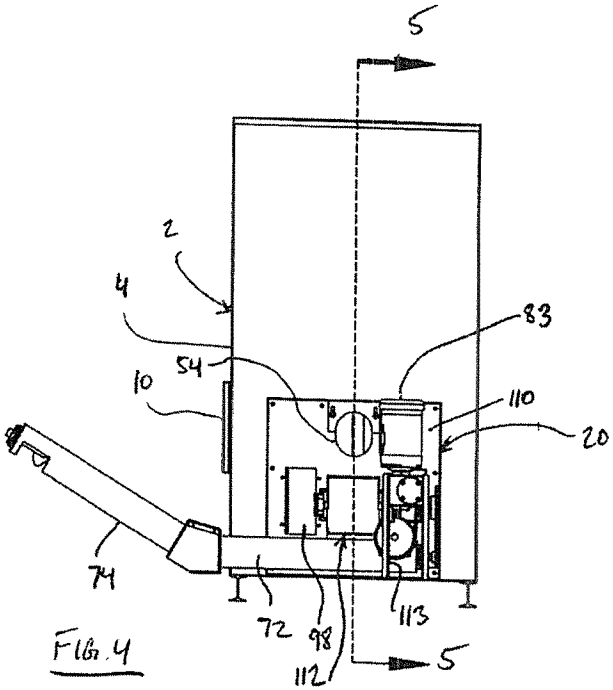
FIG. 4 is an end elevational view of the arrangement of furnace of FIG. 1.
Figure 3:
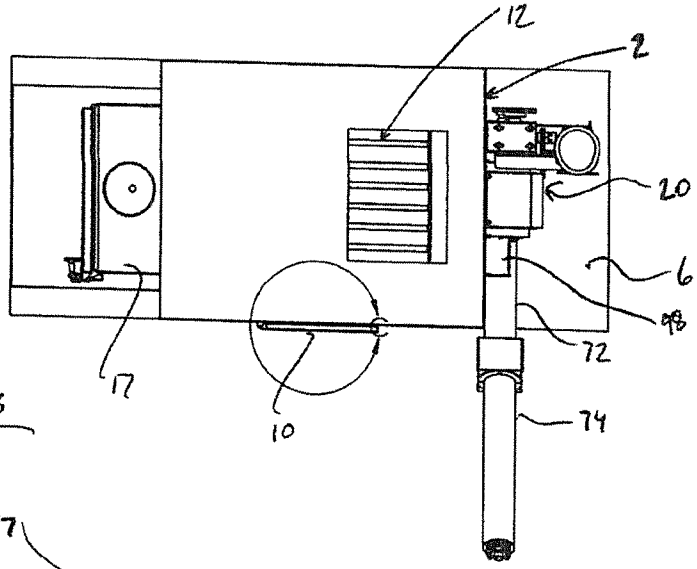
FIG. 3 is a top plan view of the arrangement of furnace of FIG. 1.
Figure 2:
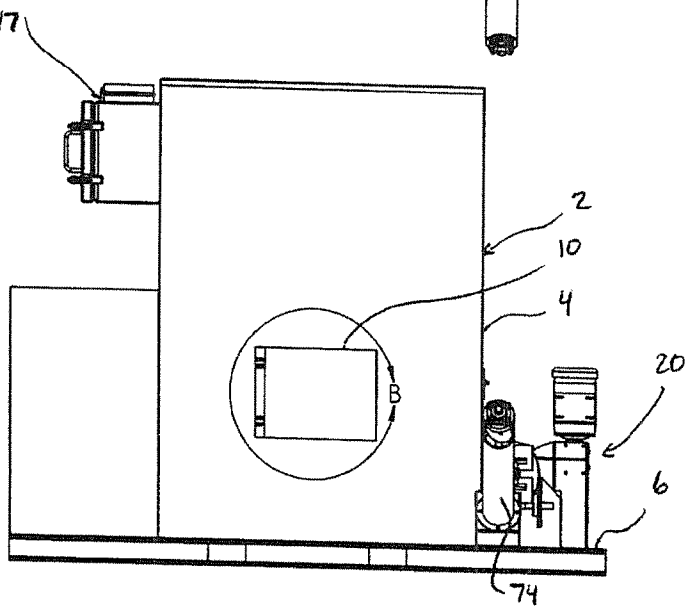
FIG. 2 is a side elevational view of the arrangement of furnace of FIG. 1.

In the accompanying figures there is shown a biomass furnace 1 for transferring heat from combustion of biomass fuel, generally in particulate form, in a combustion chamber 2 of the furnace to a heating fluid. The biomass furnace includes a fuel management system 20 having a fuel delivery conveyor 22 for supporting and displacing the fuel during combustion within the combustion chamber.

Referring to FIGS. 1-5, the combustion chamber 2 is arranged for containing the combustion of the fuel. This is basically an insulated fireproof box within which the combustion takes place comprising a plurality of upstanding walls 4 on a base 6 enclosing an interior combustion space 7. Typically there is provided an access opening 9 in one of the walls 4 which is sized for enabling inspection of the interior 7 of the chamber during combustion. A door 10 is provided to close the access opening 9.

The furnace 1 includes a heat exchanger assembly 12 in fluidic communication with the combustion chamber 2 for receiving gases generated by the combustion of the fuel and arranged to transfer heat from the gases to the heating fluid. The heat exchanger assembly 12 is disposed above the combustion chamber 2 and includes a plurality of tubes 14 through which the combustion gases are guided as they rise and exit the combustion chamber. As the gases are conveyed through the tubes 14 the heat is transferred to the heating fluid (not shown).

A flue 17 of the furnace is in fluidic communication with the heat exchanger assembly 12 downstream of the combustion chamber 2 (relative to the flow of combustion gases through the furnace) and is arranged for guiding the gases which have passed through the heat exchanger assembly 12 away therefrom, generally towards an outside environment to which the waste gases are discharged. However, the flue 17 may be fluidically communicated with a downstream scrubber (not shown) for cleaning of the combustion gases prior to discharge to the outside environment.

A fan 18 is housed externally of the combustion chamber 2 and is arranged to generate an airflow ducted as by 19 so as to flow across the heat exchanger assembly 12 to carry heat therefrom for subsequent delivery to spaces in a building to be heated. In other arrangements which are not shown, the heat carrier fluid may be a liquid, not a gas as in the illustrated arrangement, such that the fan is replaced with a pump and ducting 19 replaced with suitable piping to convey the liquid.

Figure 5:
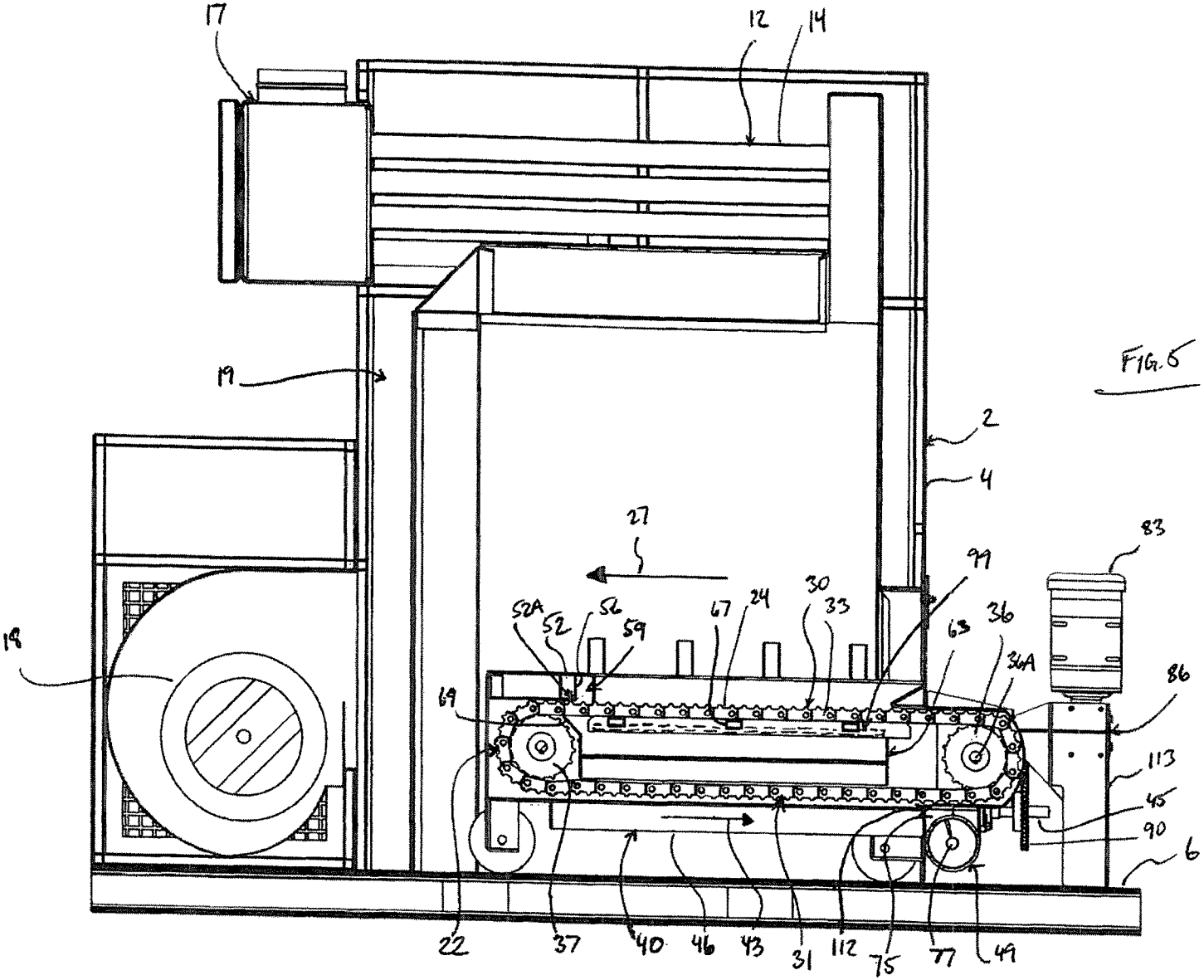
FIG. 5 is a cross-sectional view along line 5-5 in FIG. 4.
Figure 7:
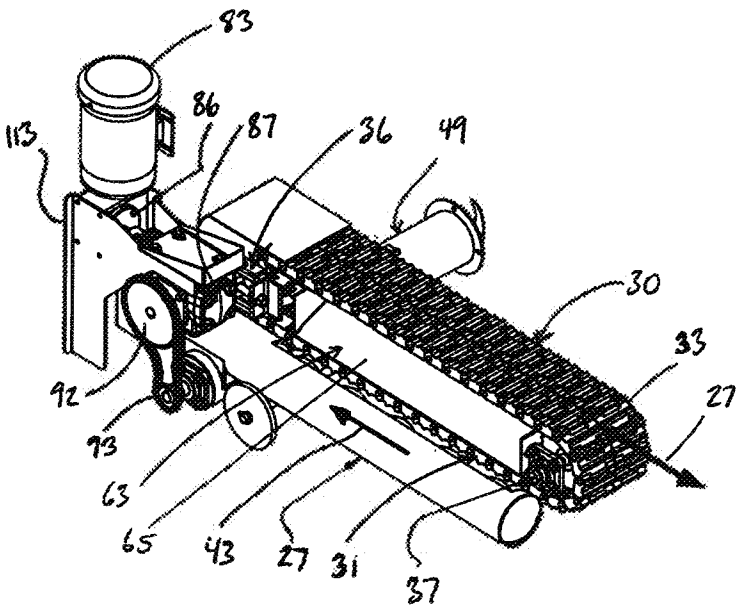
FIG. 7 is another perspective view of the arrangement of fuel management system of FIG. 6, in which some components are omitted for convenience.
Figure 6:
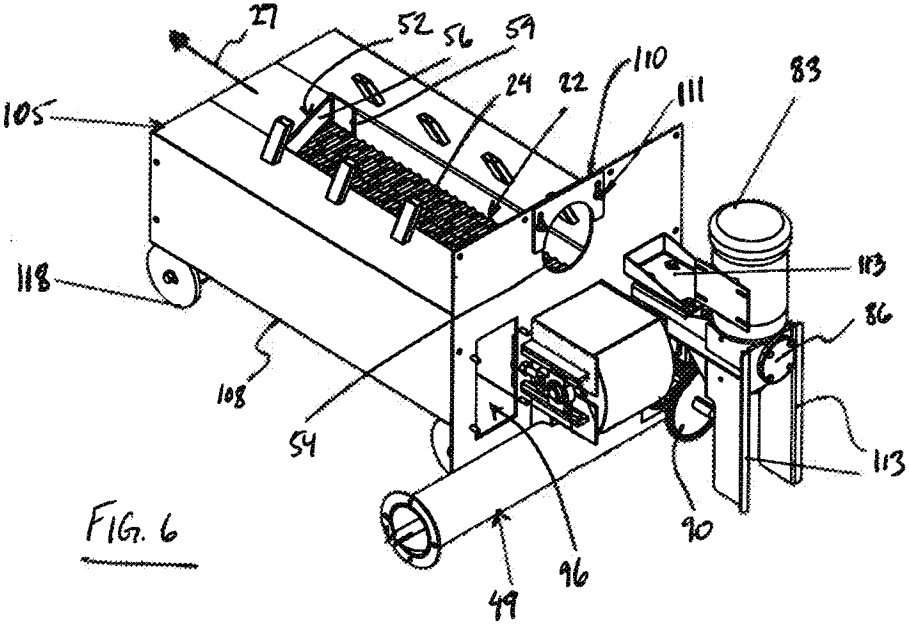
FIG. 6 is a perspective view of an arrangement of fuel management system according to the present invention.

Referring to FIGS. 5-7, the fuel management system 20 comprises the fuel delivery conveyor 22 which is arranged to be located in the combustion chamber 2 for receiving the fuel to be combusted therein. The fuel delivery conveyor 22 defines a support surface 24 for supporting the fuel during combustion, and the support surface locates a plurality of openings 25 sized to prevent passage of the fuel which is not combusted but to enable passage of ash generated by the combustion of the fuel therethrough. The fuel delivery conveyor 22 is operable to displace the fuel in a conveyance direction 27 of the fuel delivery conveyor as the fuel is being combusted in the combustion chamber 2.

Referring now to FIGS. 5 and 7, in the illustrated arrangement the fuel delivery conveyor 22 is in the form of a belt conveyor arranged for rotation about a pair of parallel axes spaced from one another in the conveyance direction 27. The conveyor 22 thus has an upper run 30 and a lower run 31 and comprises a plurality of metallic links 33 such that the upper run forms the support surface 24 in the form of a metallic grate. Each of the rotation axes are defined by a sprocket assembly 36 or 37 around which the endless loop of metallic links is entrained. One of the sprocket assemblies indicated at 36 is driven and the other at 37 is idle. Although a portion of the conveyor 22 extends beyond boundaries of the combustion chamber 2 defined by its walls 4, the reason for which will be better appreciated shortly, a usable area of the upper run 30 for carrying fuel is confined to the interior 7 of the combustion chamber 2.

Still referring to FIGS. 5 and 7, the system 20 includes an ash removal conveyor 40 operatively communicated with the fuel delivery conveyor 22 to receive therefrom the ash generated by the combustion of the fuel. The ash removal conveyor 40 is arranged to transfer the ash to a location external of the combustion chamber 2 and is operable to displace the ash in a discharge direction 43 which is substantially parallel to the conveyance direction 27 of the fuel delivery conveyor and opposite thereto.

Figure 10:
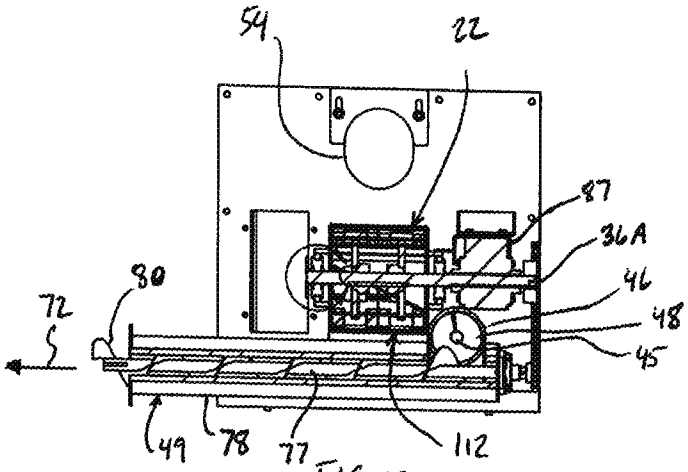
FIG. 10 is a cross-sectional view along line 10-10 in FIG. 9.
Figure 9:
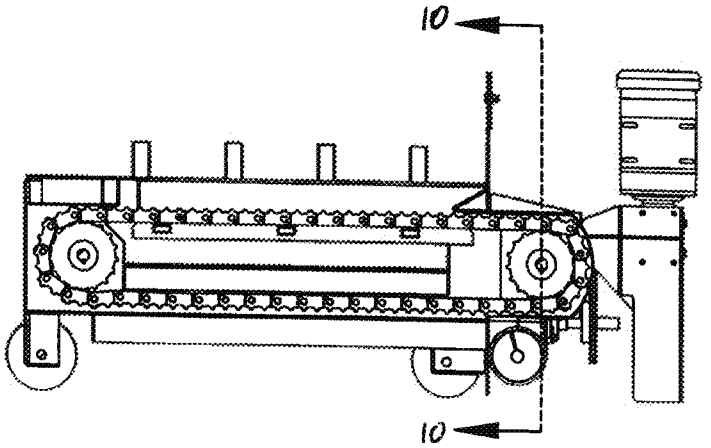
FIG. 9 is a cross-sectional view along line 9-9 in FIG. 8.

As most clearly shown in FIG. 10, in the illustrated arrangement the ash removal conveyor 40 is in the form of a screw conveyor or auger having a central shaft 45 which is mounted for rotation within a tubular housing 46 and to which a helical flight 48 is connected so that rotation of the shaft 45 in the same direction that the flight winds around the shaft is conducive to transferring the ash along the tubular housing 46 in the discharge direction 43.

Now referring back to FIG. 5, like the fuel delivery conveyor 22 the ash removal conveyor 40 is also arranged to be located in the furnace combustion chamber 2. The ash removal conveyor 40 extends past the wall 4 of the combustion chamber where there is located, externally of the combustion chamber 2, an ash transfer conveyor 49 operatively communicated with the ash removal conveyor 40 to receive the ash therefrom and convey the ash to a farther location from the furnace, such as towards waste.

As more clearly shown in FIG. 10, the ash removal conveyor 40 is located to one side of the fuel delivery conveyor 22 so that the ash is transferred thereto by movement generally in a direction transverse to the conveyance direction 27 of the fuel delivery conveyor. Also, the ash removal conveyor 40 is located at a height below the support surface 24 of the fuel delivery conveyor so that the ash can be transferred to the removal conveyor by the assistance of gravity.

Figure 8:
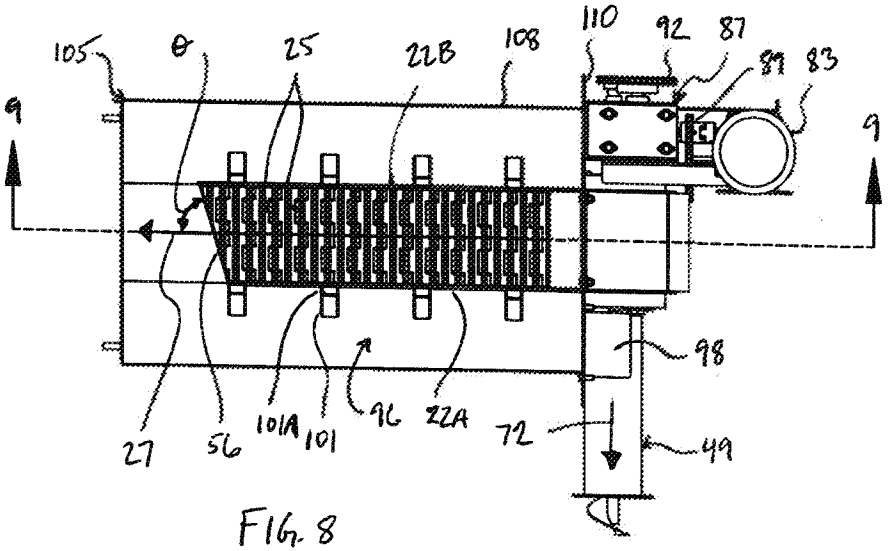
FIG. 8 is a top plan view of the arrangement of fuel management system of FIG. 6.

Referring now to FIGS. 6 and 8, to transfer ash which has been retained on the support surface 24 and towards the ash removal conveyor 40, the system 20 includes a guide member 52 supported over the support surface 24 of the fuel delivery conveyor at a spaced location from an inlet 54 through which the fuel is passed to the fuel delivery conveyor to substantially obstruct passage of ash in the conveyance direction 27 past the guide member 52. That is, a bottom 52A of the guide member 52 is located just above the support surface 24 so as to permit passage of the links 33 thereunder but to substantially retain the ash at a location of the guiding retention member 52 along the fuel delivery conveyor 22. The guide member 52 defines a planar smooth surface 56 upstanding to the support surface 24 and oriented at an acute angle θ to the conveyance direction 27 of the fuel delivery conveyor so as to guide the ash to one side of the fuel delivery conveyor for subsequent transfer to the ash removal conveyor 40. Thus as the fuel delivery conveyor 22 continues to operate in the conveyance direction 27, the ash retained on the support surface 24 interacts with the upstanding surface 56 and gradually shifts to the side of the delivery conveyor 22 where there is located a discharge opening 59 through which the ash passes towards the removal conveyor 40. In the illustrated arrangement the upstanding surface spans substantially the full width of the support surface 22 so as to guide all of the retained ash to a common side.

As more clearly shown in FIG. 7, additionally to the retaining guide member 52 the fuel management system 20 includes a chute 63 extending underneath the support surface 24 and arranged to guide the ash which has passed through the openings 25 in the support surface 24 to the ash removal conveyor 40 by gravity. The chute 63 defines an upper guide surface 65 extending in the conveyance direction 27, that is the surface 65 is elongated in same, and sloped downwardly to one side of the fuel delivery conveyor 22 to guide the ash towards the ash removal conveyor 40. As the ash removal conveyor 40 is located to one side of the delivery conveyor 22, the upper guide surface 65 of the chute is sloped downwardly towards this same side. Also, a top chute opening subjacent the support surface 24 substantially spans the full length of the usable portion of the upper run 30 of the fuel delivery conveyor. A plurality of upper run support members 67 extending perpendicularly transversely to the conveyance direction 27 may interrupt the chute opening at longitudinally spaced locations of the fuel delivery conveyor 22 without substantially interfering with an ability of the chute to capture the falling ash. A rear end 69 of the chute is located at a position spaced in the conveyance direction 27 from the upstanding retaining guide surface 56 such that the chute extends underneath the guide member 52 so that any ash which passes underneath the guide member 52 may still be captured by the chute 63.

Referring to FIGS. 5-8, with the ash transferred to the ash removal conveyor 40 which acts to remove the ash from the combustion chamber 2, upon removal therefrom the ash is transferred to the ash transfer conveyor 49 which displaces the ash away from the combustion chamber 2 but in a different direction from the discharge direction 43 which would otherwise lead to a fuel supply (not shown) for the biomass furnace, as the ash removal conveyor 40 protrudes from the furnace wall 4 in which the inlet 54 for communicating the fuel supply with the combustion chamber 2 is formed. The ash transfer conveyor 49 is transversely oriented to the ash removal conveyor 40 and is operable to displace the ash in a transverse direction 72 to the discharge direction 43. In the illustrated arrangement, the ash transfer conveyor 49 is oriented perpendicularly transversely to the ash removal conveyor and is operatively communicated with an inclined conveyor 74 to transfer the ash thereto, as more clearly shown in FIG. 4. The inclined conveyor 74 is operable to raise the ash for dumping into a waste collection receptacle (not shown).

As more clearly shown in FIG. 10, the ash transfer conveyor 49 is disposed under an end 75 of the ash removal conveyor 40 which is external to the combustion chamber 2 protruding beyond the furnace wall 4 so that the ash is dropped by gravity out of the removal conveyor 40 for subsequent transfer by the transfer conveyor 49. The ash transfer conveyor 49 is in the form of a screw conveyor having a central shaft 77 mounted for rotation within a tubular housing 78 and to which a helical flight 80 is connected.

Thus the fuel management system 20 is able to support continuous combustion of the fuel within the combustion chamber 2 by displacing the fuel under combustion from the inlet 54 so that the combustion chamber 2 can be charged with further fuel, and by removing ash as it is generated so that the combustion chamber is automatically cleaned.

Still Referring to FIGS. 5-10, both the fuel delivery 22 and ash removal 40 conveyors are operatively coupled to a common drive motor 83 arranged to be located externally of the combustion chamber 2 which actuates the fuel delivery conveyor to displace the fuel and the ash removal conveyor to displace the ash. At least one transmission is provided to operatively interconnect the drive motor 83 and drive shafts of the fuel delivery and ash removal conveyors. The at least one transmission is arranged to be mounted externally of the combustion chamber, similarly to the motor 83. The drive shaft of the fuel delivery conveyor 22 is defined by a shaft 36A of the drive sprocket assembly 36 and the drive shaft of the ash removal conveyor is defined by the central shaft 45 thereof.

In the illustrated arrangement, the drive shafts of the fuel delivery conveyor 22 and the ash removal conveyor 40 are transversely oriented to one another such that first and second transmissions 86, 87 are provided in order to drive the two distinct conveyors using the same motor. More specifically, the first transmission 86 whose output shaft is parallel to the drive shaft 45 of the ash removal conveyor is directly connected to the motor 83. As the motor 83 is mounted at a spaced height above the base 6 of the furnace, the first transmission 86 is mounted under the motor but also is disposed at a spaced height above the base 6 such that the output shaft carries a gear 89 which via a chain drives a gear 90 mounted to rotate with the drive shaft 45 of the ash removal conveyor which is located spaced below and to one side from the output shaft of the first transmission. In this manner the first transmission 86 operatively interconnects the common drive motor 83 and the drive shaft 45 of the ash removal conveyor 40.

The second transmission 87 is directly connected to the first transmission so as to be operatively connected to the drive motor 83 via the first transmission 86. The second transmission 87 is located at a common height above the base 6 as the first transmission and is directly connected to the shaft of the drive sprocket assembly 36 of the fuel delivery conveyor 22. Thus the second transmission 87 operatively interconnects the common drive motor 83 and the fuel delivery conveyor.

As a drive shaft of the ash transfer conveyor 49, which is defined by the shaft 77, is oriented substantially parallel to the drive shaft 36A of the fuel delivery conveyor, the second transmission 87 also is operatively connected to the ash transfer conveyor 49 so that the common drive motor 83 is operatively coupled to same to actuate the ash transfer conveyor to displace the ash. At the second transmission 87 there is provided a gear 92 which via a chain drives a gear 93 mounted on the drive shaft 77 of the ash removal conveyor disposed spaced below the second transmission.

Thus a single drive source is provided for all of the distinct conveyors of the fuel management system.

Referring to FIG. 5, the fuel management system 20 also includes ducting 96 arranged to convey airflow generated by a blower 98 (schematically shown) for subsequent discharge into the combustion chamber 2. The ducting defines at least one orifice 99 below the support surface 24 of the fuel delivery conveyor 22 to supply the airflow at a location beneath the fuel and also includes one or more air nozzles 101 at spaced locations along the conveyance direction 27 and extending in a generally upward direction above the support surface 24 for supplying the airflow at a location above the fuel. That is, the air nozzles 101 which may be termed in industry as overfire air nozzles have discharge openings 101A at a height above the support surface 24 supporting the fuel so as to feed air to the flames of combustion.

The orifice 99 is in the form of an elongated slot formed in the ducting 99 above the chute, and more specifically over an upper end thereof. The orifice 99 extends horizontally across substantially a full width of the chute so as to be configured to provide the airflow used to supply the combustion of the fuel across the width of the chute 63 to assist gravity discharge of the ash to the ash removal conveyor 40, which eventually conveys the ash to waste. It will be appreciated that the orifice 99 is shown in stippled line as it is formed on a portion of the ducting which is not actually shown in FIG. 5, but rather on an opposite side to that shown therein.

The ducting 96 extends generally in a U shape from one side 22A of the fuel delivery conveyor 22, around an end of the support surface 24 of the fuel delivery conveyor arranged at a spaced location from the inlet 54 through which the fuel is passed to the fuel delivery conveyor, which in the illustrated arrangement is defined by the upstanding guide surface 56, and to the other side 22B of the fuel delivery conveyor. The one or more air nozzles comprises a plurality of air nozzles 101 located on either side 22A, 22B of the fuel delivery conveyor 22, as more clearly shown in FIG. 6 or 8. Furthermore, there is provided a single blower 98 arranged to provide the airflow that is mounted externally of the combustion chamber 2 to one side of the fuel delivery conveyor 22 in fluidic communication with the ducting 96. Thus the airflow is conveyed by the ducting 96 from a single source for discharge on either side of the fuel delivery conveyor 22.

As such, a single source of forced air can be used to suitably supply an airflow for combustion.

In order to provide easier maintenance, the fuel delivery conveyor 22 is operably mounted on a removable housing 105 which is arranged to be removably insertible into the combustion chamber 2 of the furnace through an opening 106 defined by the combustion chamber. The ash removal conveyor 40 and the ash transfer conveyor 49 are also operably mounted on the housing 105 so as to be movable relative to the combustion chamber with the housing which is thus a common support for all of the distinct conveyors of the fuel management system.

In the illustrated arrangement the housing 105 comprises a box-shaped main body portion 108 which is received in the combustion chamber during use, and which carries the fuel delivery conveyor 22 and the ash removal conveyor 40. The main body portion 108 is substantially enclosed and thus defines an enclosed support for the fuel delivery and ash removal conveyors. The ducting 96 is also defined thereby, with suitable interior walls arranged to guide the airflow from the proximal side 22A of the fuel delivery conveyor 22 on which the blower 98 is located to the distal side 22B of the delivery conveyor 22. The housing also comprises an exterior wall 110 connected to the main body portion 108 and arranged to be located on an exterior side of the combustion chamber 2 in use. The exterior wall 110 acts to close the opening 106 of the combustion chamber 2 in use and defines the fuel supply inlet 54 which arranged to permit passage of the fuel from the fuel supply located externally of the combustion chamber 2 to the fuel delivery conveyor 22. The ash transfer conveyor 49 is mounted to the exterior wall 110 and extends along same. Additionally, the exterior wall 110 is arranged with a mounting location 111 to receive an auger of the fuel supply mounted fixedly to the wall 110.

The housing 105 defines an opening 112 beneath the lower run 31 of the fuel delivery conveyor and vertically above the ash transfer conveyor 49 such that ash which is displaced by the conveyor 22 past the guide member 52, and which continues to be displaced along the lower run 31 as if to circulate back to the upper run 30, is enabled to be discharged from the housing 105. An upstanding surface may be provided along a leading side of the opening 112 relative to a direction of movement of the fuel delivery conveyor 22 along the lower run 31, and projecting inwardly into the housing 105 so as to prevent the ash from recirculating to the upper run 30 and to urge the ash downwardly to the ash transfer conveyor 49. Thus, in some arrangements, the ash removal conveyor 40 may be excluded and only the ash transfer conveyor 49 may be provided as the ash removal device, with a delivery mechanism of the ash thereto being the lower run 31 of the belt-style fuel delivery conveyor.

The motor 83 and the transmissions 86, 87 are also operably mounted to the removable housing 105 by a framework 113 which is connected on an exterior side of the exterior wall 110. The framework 113 comprises a pair of L-shaped brackets in the form of legs, which at one end attach to the exterior wall 110 and which at the other end are arranged to rest on the base 6.

The housing 105 is supported for movement relative to the furnace 1, through the opening 106 which is sized to permit passage of the housing into and out of the combustion chamber 2, by a set of wheels 118 rotatably mounted on a bottom of the main body portion 108. The wheels 118 rollably support the housing on the base 6 which defines a planar upper support surface.

The foregoing arrangement works particularly well with wood chips as the biomass fuel which generate ash when combusted.

The scope of the claims should not be limited by the preferred embodiments set forth in the examples but should be given the broadest interpretation consistent with the specification as a whole.

The invention claimed is:

1. A fuel management system for a biomass furnace having a combustion chamber, comprising:

a fuel delivery conveyor arranged to be located in the combustion chamber for receiving biomass fuel to be combusted therein, the fuel delivery conveyor defining a support surface for supporting the fuel during combustion and being operable to displace the fuel as the fuel is being combusted in the combustion chamber;

an ash removal conveyor operatively communicated with the fuel delivery conveyor to receive therefrom ash generated by the combustion of the fuel, the ash removal conveyor being arranged to transfer the ash to a location external of the combustion chamber;

an ash transfer conveyor arranged externally of the combustion chamber and operatively communicated with the ash removal conveyor to receive the ash therefrom, the ash transfer conveyor being transversely oriented to the ash removal conveyor and being operable to displace the ash in a transverse direction to the discharge direction;

a common drive motor operatively coupled to both the fuel delivery conveyor and the ash removal conveyor to actuate the fuel delivery conveyor to displace the fuel and the ash removal conveyor to displace the ash, wherein the ash transfer conveyor is also operatively coupled to the common drive motor so as to be actuated thereby to displace the ash in the transverse direction;

wherein the fuel delivery conveyor is operable to displace the fuel in a conveyance direction of the fuel delivery conveyor and the ash removal conveyor is operable to displace the ash in a discharge direction which is substantially parallel to the conveyance direction of the fuel delivery conveyor;

wherein drive shafts of the fuel delivery conveyor and the ash transfer conveyor are substantially parallel and a drive shaft of the ash removal conveyor is transversely oriented to the drive shaft of the fuel delivery conveyor;

a first transmission operatively interconnecting the common drive motor and the drive shaft of the ash removal conveyor; and a second transmission operatively interconnecting the common drive motor and the drive shaft of each of the fuel delivery conveyor and the ash transfer conveyor.

2. The fuel management system of claim 1 further including a guide member supported over the support surface of the fuel delivery conveyor at a spaced location from an inlet through which the fuel is passed to the fuel delivery conveyor to substantially obstruct passage of ash in the conveyance direction of the fuel delivery conveyor in which the fuel is displaced thereby, the guide member defining an upstanding surface to said support surface which is oriented at an acute angle to the conveyance direction of the fuel delivery conveyor so as to guide the ash to one side of the fuel delivery conveyor.

3. The fuel management system of claim 1 wherein the support surface of the fuel delivery conveyor locates a plurality of openings sized to prevent passage of the fuel which is not combusted but to enable passage of the ash therethrough, and there is provided a chute extending underneath the support surface and arranged to guide the ash which has passed through the openings to the ash removal conveyor by gravity.

4. The fuel management system of claim 3 wherein the chute defines an upper guide surface extending in the conveyance direction and sloped downwardly to one side of the fuel delivery conveyor to guide the ash towards the ash removal conveyor.

5. The fuel management system of claim 3 wherein, when the system further includes a guide member supported over the support surface of the fuel delivery conveyor at a spaced location from an inlet through which the fuel is passed to the fuel delivery conveyor and defining an upstanding surface to the support surface to substantially obstruct passage of ash in the conveyance direction, an end of the chute is spaced from the upstanding surface in the conveyance direction so as to capture ash passing under the guide member.

6. The fuel management system of claim 1 wherein the second transmission is operatively connected to the drive motor via the first transmission.

7. The fuel management system of claim 1 further including ducting arranged to convey airflow generated by a blower for subsequent discharge into the combustion chamber, and wherein, when the support surface of the fuel delivery conveyor locates a plurality of openings sized to prevent passage of the fuel which is not combusted, the ducting defines at least one orifice below the support surface of the fuel delivery conveyor to supply the airflow at a location beneath the fuel and also includes one or more air nozzles at spaced locations along the conveyance direction and extending in a generally upward direction above the support surface for supplying the airflow at a location above the fuel.

8. The fuel management system of claim 7 wherein, when the support surface of the fuel delivery conveyor locates a plurality of openings sized to prevent passage of the fuel which is not combusted but to enable passage of the ash therethrough, and when the fuel management system further includes a chute extending underneath the support surface and arranged to guide the ash which has passed through the openings to the ash removal conveyor by gravity, the at least one orifice is disposed above the chute and is configured to provide the airflow across a width of the chute to assist discharge of the ash to the ash removal conveyor.

9. The fuel management system of claim 7 wherein the ducting extends generally in a U shape from one side of the fuel delivery conveyor, around an end of the support surface of the fuel delivery conveyor arranged at a spaced location from an inlet through which the fuel is passed to the fuel delivery conveyor, and to the other side of the fuel delivery conveyor, and wherein the one or more air nozzles comprises a plurality of air nozzles located on either side of the fuel delivery conveyor.

10. The fuel management system of claim 7 further including a single blower mounted in fluidic communication with the ducting and arranged to provide the airflow.

11. The fuel management system of claim 10 wherein the single blower is mounted to one side of the fuel delivery conveyor.

12. The fuel management system of claim 1 wherein the fuel delivery conveyor is operably mounted on a housing which is arranged to be removably insertible into the combustion chamber of the furnace.

13. The fuel management system of claim 12 wherein, when the fuel management system further includes ducting arranged to convey airflow generated by a blower for subsequent discharge into the combustion chamber and which extends generally in a U shape from one side of the fuel delivery conveyor, around an end of the support surface of the fuel delivery conveyor arranged at a spaced location from an inlet through which the fuel is passed to the fuel delivery conveyor, and to the other side of the fuel delivery conveyor, the housing defines the ducting.

14. The fuel management system of claim 13 wherein the housing comprises an exterior wall arranged to be located on an exterior side of the combustion chamber in which a ducting inlet is defined so as to communicate the ducting and the blower located externally of the housing.

15. The fuel management system of claim 12 wherein, the ash transfer conveyor is operably mounted on the common housing so as to be movable relative to the combustion chamber with the housing.

16. The fuel management system of claim 12 wherein, when the combustion chamber of the biomass furnace defines an opening arranged to permit passage of the housing into and out of the combustion chamber, the housing comprises an exterior wall arranged to be located on an exterior side of the combustion chamber and to close said opening of the combustion chamber and an inlet is defined in the exterior wall and arranged to permit passage of the fuel from a fuel supply located externally of the combustion chamber to the fuel delivery conveyor.

17. The fuel management system of claim 1 wherein the drive motor is arranged to be located externally of the combustion chamber.

18. The fuel management system of claim 17 wherein the first and second transmissions are arranged to be mounted externally of the combustion chamber.

* * * * *